US005123222A

United States Patent [19]

Guarriello et al.

[11] Patent Number: 5,123,222

[45] Date of Patent: * Jun. 23, 1992

[54] PLASTIC FORMS FOR POURED CONCRETE

[75] Inventors: Theodore J. Guarriello, Warminster; Henry J. Guarriello, Jr., Richboro; Joseph A. Guarriello, Newtown, all of Pa.

[73] Assignee: Reddi Form, Inc., Fairless Hills, Pa.

[ * ] Notice: The portion of the term of this patent subsequent to May 14, 2008 has been disclaimed.

[21] Appl. No.: 687,340

[22] Filed: Apr. 18, 1991

Related U.S. Application Data

[63] Continuation-in-part of Ser. No. 541,759, Jun. 21, 1990, Pat. No. 5,014,480.

[51] Int. Cl.[5] ..... E04C 1/00

[52] U.S. Cl. ..... 52/309.12; 52/439; 52/594

[58] Field of Search ..... 52/436, 437, 439, 591, 52/594, 309.12

[56] References Cited

U.S. PATENT DOCUMENTS

| | | | |
|---|---|---|---|
| 4,884,382 | 12/1989 | Horobin | 52/309.12 |
| 4,894,969 | 1/1990 | Horobin | 52/309.12 |
| 5,014,480 | 5/1991 | Guarriello et al. | 52/309.12 |
| 5,024,035 | 6/1991 | Hanson et al. | 52/309.12 |

*Primary Examiner*—David A. Scherbel
*Assistant Examiner*—Joanne C. Downs
*Attorney, Agent, or Firm*—Mathews, Woodbridge & Collins

[57] ABSTRACT

A hollow foamed plastic form for concrete has a pair of opposed parallel side walls with planar upper and lower faces, and a pair of opposed end members. Disposed on the upper and lower faces of the side walls are a series of elongated locking members, each composed of a pair of offset ribs having a trapezoidal or rectangular shape.

5 Claims, 4 Drawing Sheets

PLASTIC FORMS FOR POURED CONCRETE

CROSS-REFERENCE TO RELATED APPLICATIONS

This is a continuation-in-part of Ser. No. 07/541,759 filed Jun. 21, 1990, now U.S. Pat. No. 5,014,480.

The present invention relates to improved plastic modular forms for concrete.

BACKGROUND OF THE INVENTION

A construction method gaining wide acceptance today involves the construction of a form from modular hollow plastic units which then are filled with concrete. The concrete is allowed to set with the plastic form remaining in place. A number of approaches of this method have been described previously.

U.S. Pat. No. 3,383,817 to Gregori discloses a form structure for concrete having two side-by-side composite panel members and a plurality of tension members interconnecting the panel members.

U.S. Pat. No. 3,552,076 to Gregori discloses a self-supporting concrete form of foamed polymeric material having end and side walls and at least one partition between the side walls with projections and recesses on the upper and lower edges of the side walls for interlocking several of the forms.

U.S. Pat. No. 3,788,020 to Gregori discloses a self-supporting concrete form of foamed polymeric material in which two side walls are joined by a transverse sheet metal tension member. The side walls have a tongue and groove arrangement on the upper and lower surfaces and end portions for interlocking several of the forms.

U.S. Pat. No. 4,223,501 to DeLozier discloses a one piece transverse connecting member having a plurality of openings for self-supporting concrete forms of the type disclosed in U.S. Pat. No. 3,778,020.

U.S. Pat. No. 4,439,967 to Dielenberg discloses a plastic formwork for concrete having a complex interlocking configuration on the upper and lower edges of the side and end walls.

U.S. Pat. No. 4,516,372 to Grutsch discloses a concrete form having a plurality of panels with shiplap joint edges which are held in place by metal ties, U.S. Pat. No. 4,577,447 to Doran discloses a plastic building block form constructed from two parts adhesively bound together and presenting a series of horizontally and vertically aligned openings to accommodate the flow of concrete.

U.S. Pat. No. 4,604,843 to Ott discloses concrete forms having horizontal base elements, horizontal connecting elements, and ladder-like vertical elements bridging the slabs of the form.

U.S. Pat. No. 4,698,947 to McKay discloses an insulated wall of spaced-apart foamed plastic sheets (between which concrete is poured) with a plurality of sheet metal ties holding the sheets together.

U S. Patent No. 4,706,429 and U.S. Pat. No. 4,730,422 to Young disclose a plastic wall tie for modular foamed plastic concrete forms having a pair of triangular truss sections and T-shaped end sections.

U.S. Pat. No. 4,731,968 to Obino discloses a concrete formwork having two panel members, each having a plurality of plugs on its upper side and corresponding recesses in its lower side, together with associated cross members.

U.S. Pat. No. 4,742,659 to Meilleur discloses a formwork for concrete having two separate foam modules and a combination of tie and coupling rods.

U.S. Pat. No. 4,750,308 to McKay discloses tie members for spaced apart plastic sheets having a pair of metal plates joined by twisted metal strips.

U.K Patent Specification No. 985,914 to Hinse discloses hollow artificial stones or blocks having complementary tongue and grooves on the top and bottom faces which are stacked in interlocking relationship and filled with concrete.

U.K Patent Specification No. 1,385,045 to Ito discloses a partition element of two parallel rectangular plates linked together with bridge members.

French Patent No. 2,394,647 discloses plastic forms for concrete having complementary mortise and tenon joints.

DETAILED DESCRIPTION

The nature of the present invention will be apparent from the following detailed description and the accompanying drawings, in which.

Figure 1:
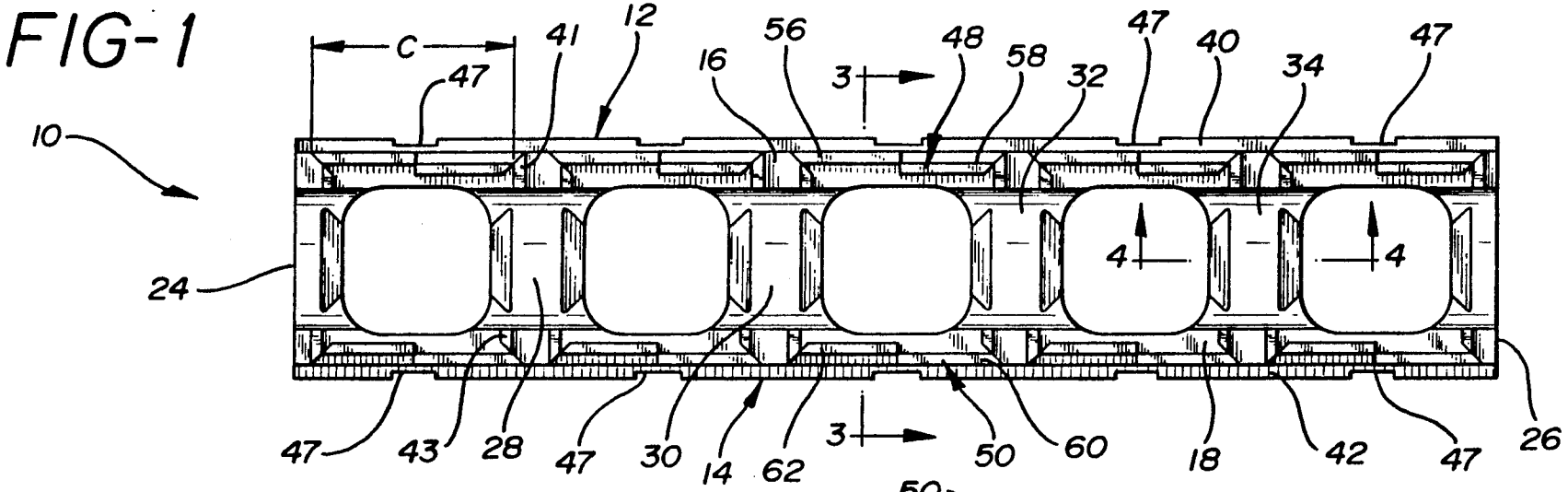
FIG 1 is a top view of the concrete form of the present invention.
Figure 2:
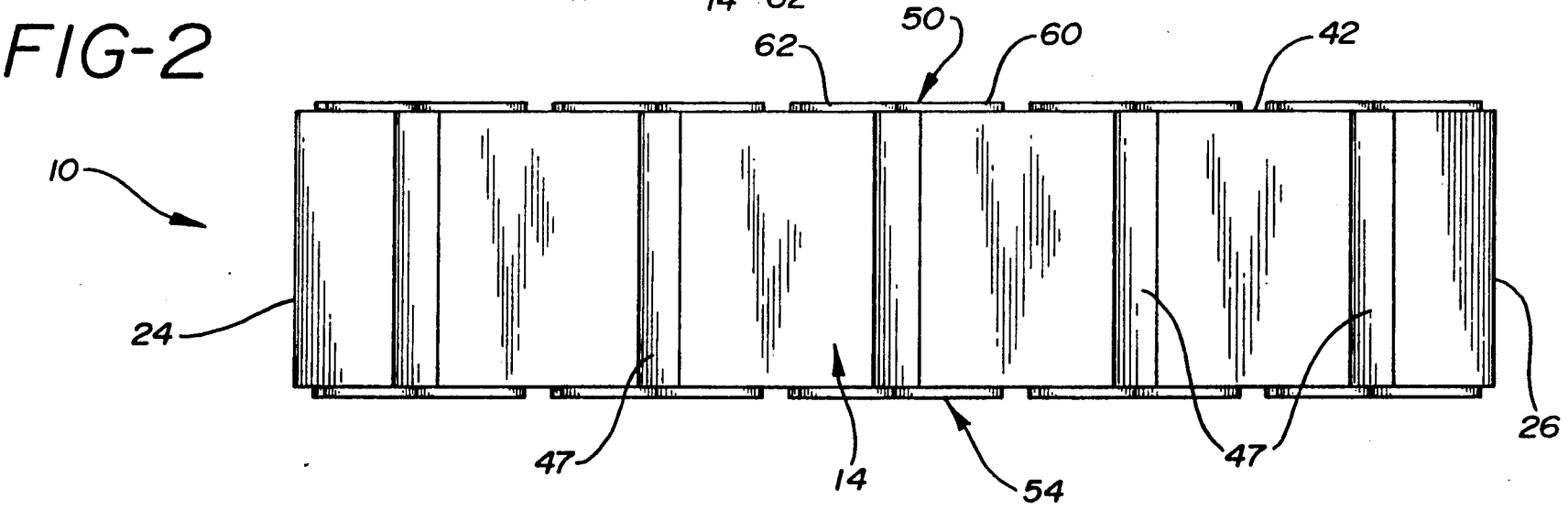
FIG. 2 is a side elevation of the concrete form shown in FIG. 1.
Figure 3:
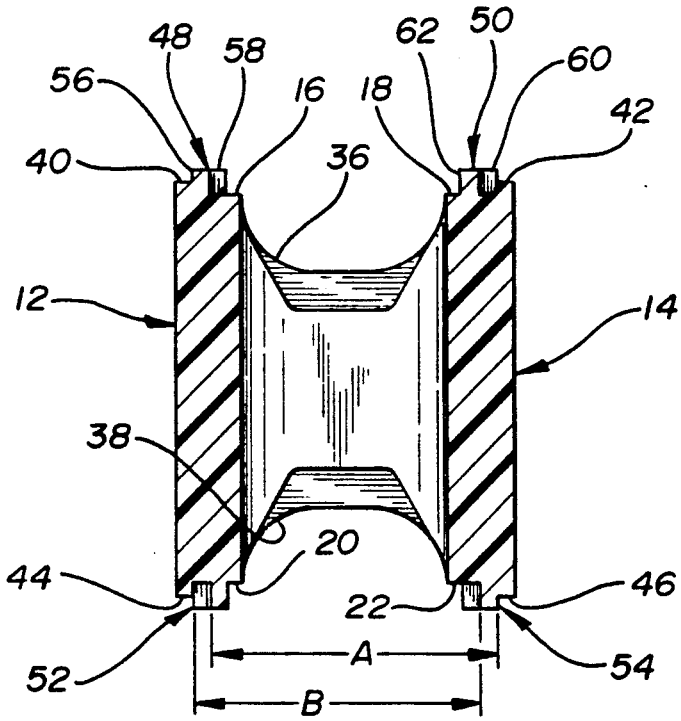
FIG. 3 is a cross-section taken along lines 3—3' of FIG. 1.
Figure 4:
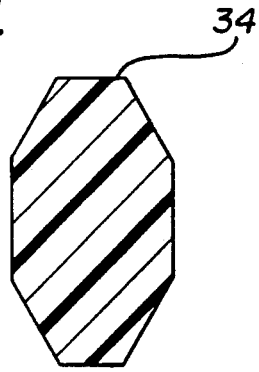
FIG. 4 is a cross-section taken along lines 4—4' of FIG. 1.

With reference to FIGS. 1, 2 and 3, there is provided a hollow foamed plastic form 10 having a pair of opposed parallel side walls 12 and 14 with planar upper and lower faces 16, 18, 20 and 22, and a pair of opposed end members 24 and 26.

Typically the form will have several interior separators 28, 30, 32, and 34 which define a plurality of discrete cavities of like configuration into which is poured concrete. In the form as seen in FIG. 1, five such cavities are shown, although it will be recognized that this number is not critical. The cavities are defined by portions of opposed parallel side walls 12 and 14 on the one hand and either two interior separators, such as separators 28 and 30, or one interior separator, such as 28, and an end member, such as 24, on the other. In the embodiment of FIG. 1, opposed end members 24 and 26 correspond in configuration to "half" a separator, that is, the shape which would result upon bisecting a separator through a vertical plane. All of the interior separators have a portion removed, resulting in concave openings 36 and 38 which permit passage of uncured concrete between two or more vertical cavities, discussed in greater detail below.

Disposed on and extending outwardly from each of upper and lower faces 16, 18, 20, and 22 is a lip 40, 42, 44, and 46 which is coplanar with the outer surface of its associated side walls 12 and 14.

While not critical, outer faces 12 and 14 can be provided with a slight vertical groove 47, typically less than 1/32" in depth, which is aligned with each cavity and which not only assists in placing a plurality of forms in registry but also provides an exterior indication of the location of concrete (as opposed to plastic separators 28, 30, for subsequent workers. When several forms are thus assembled, the visible joint lines are smooth, not only providing an improved appearance but also avoiding uneven joints which can cause sink marks with interior finishes.

Figure 8:
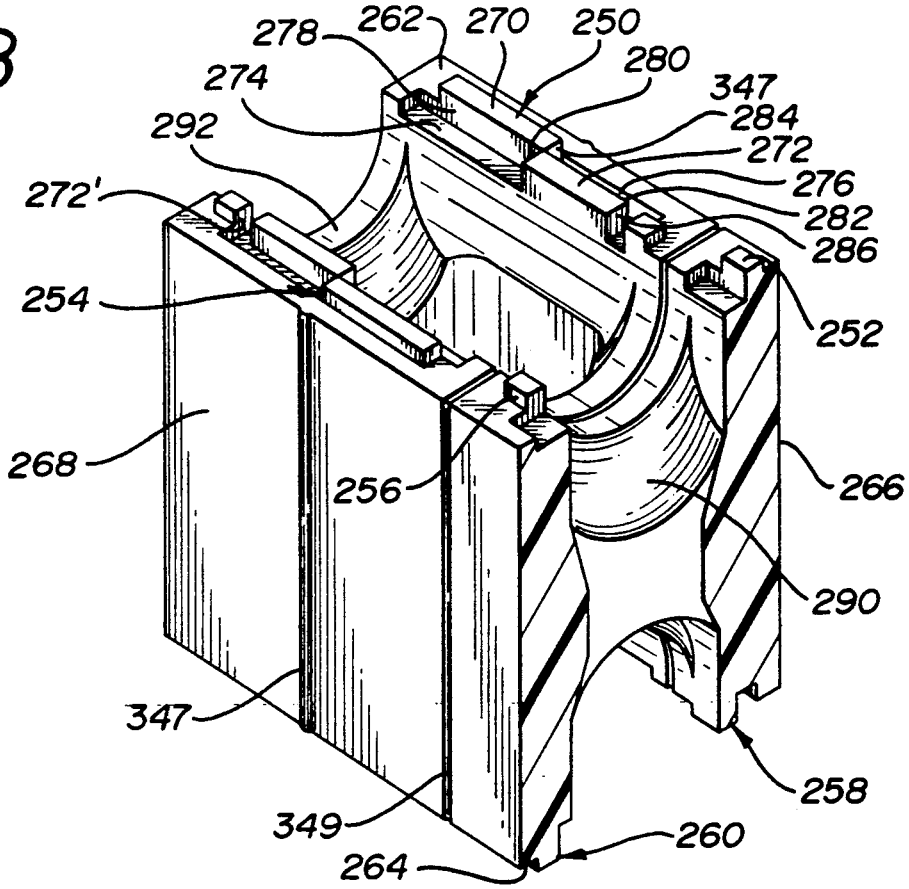
FIG. 8 is a partial sectional isometric view of an alternative embodiment of the present invention.

As shown in FIG. 8, the vertical groove can be replaced with a vertical bead 347, serving the identical function. Similarly a slight indentation 349 can be provided to mark the transverse ribs (discussed below) and provide guidance for cutting a form through such a rib.

Returning to FIGS. 1, 2 and 3, on the upper and lower faces 16, 18, 20, and 22 of each side walls inside lips 40, 42, 44, and 46 and in registered spaced relationship are a plurality of like elongated locking members, two of which 48 and 50 are identified in FIG. 1 and four of which 48, 50, 52, and 54, are identified in FIG. 3.

Each locking member is spaced from a corresponding locking member on the other side wall at a distance corresponding to the length of each locking member. Thus the distance A in FIG. 3 equals distance C in FIG. 1 and also equals the distance B in FIG. 3.

Each locking member consisting of a pair of first and second elongated ribs. Thus locking member 48 consists of first rib 56 and second rib 58 while locking member 50 consists of first rib 60 and second rib 62. All the ribs are of uniform thickness and a uniform height which height is nominally twice the height of lip 40, 42, 44, and 46. First rib 56 and 60 has a length which is greater than that of second rib 58 and 62 by a factor corresponding to the width of rib, thereby compensating for the offset of the first rib from the second rib.

Figure 5:
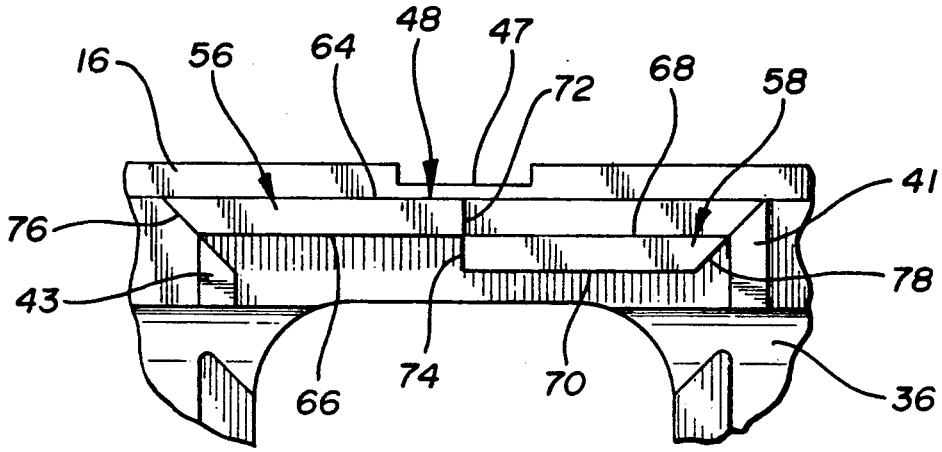
FIG. 5 is an enlarged top view of a locking member utilized in the present invention.

Each rib, in top view as shown in FIGS. 1 and 5, has a trapezoidal shape defined by (a) first and second parallel vertical planar surfaces 64 and 66 with respect to rib 56 and first and second parallel vertical planar surfaces 68 and 70 with respect to rib 58, all of surfaces 64, 66, 68, and 70 being substantially parallel to side wall 12; (b) a third vertical planar surface 72 and 74 which is perpendicular to the first and second planar surfaces 64 and 66 (with respect to 72) and 68 and 70 (with respect to 74); and (c) a fourth vertical planar surface 76 and 78 intersecting the first and second planar surfaces at angles of 45° and 135°, respectively.

The ribs of each pair are offset, first rib 56 of locking member 48 being disposed more proximate to lip 40 than second rib 58, and the same is true of each pair of ribs comprising a locking member. Third planar surfaces 72 and 74 of the two ribs are coplanar and the second planar surface 66 of first rib 56 is coplanar with first planar surface 68 of second rib 58 and the same is true of each pair of ribs comprising a locking member.

Preferably first parallel planar surfaces 64 and 68 are disposed outwardly from second parallel planar surfaces 66 and 70 so that both fourth planar surfaces 76 and 78 converge towards the interior of the form and the same is true of each pair of ribs comprising a locking member.

Partial transverse ribs 41 and 43 are disposed perpendicular to ribs 58 and 60 and similarly engage the ribs of a corresponding elongated locking member placed on top of or below the depicted form at 90°. Such partial ribs are identical at their extremes to that shown in FIG. 5 but lack the interior portion corresponding to concave openings 36 and 38. Similar transverse ribs can be and preferably are associated with each cavity, not only providing additional rigidity but also permitting perpendicular orientation at any point.

Since the locking elements on the "top" and "bottom" complement one another, a plurality of forms can be assembled in interlocking relationship. Significantly since the forms are identical on the "top" and "bottom", the worker is not limited to a single "correct" orientation. Moreover, since each form has a modular arrangement of locking elements, the forms can be assembled in staggered relationship, with a number of cavities on one form aligned with a like number of cavities of another form. In addition to aligning and locking the forms in planar relationship, as might be desirable in constructing a planar wall, the locking members also are operative for alignment and locking in perpendicular relationship, thereby permitting the construction of tees and partitions.

As previously noted, the interior separators 28, 30, 32, and 34 have a portion removed resulting in concave openings 36 and 38 permitting communication of concrete between two or more vertical cavities In the embodiment of FIG. 1, end members 24 and 26 have a similar portion removed. By corresponding in configuration to "half" a separator, end units from two abutting forms correspond in occupied space to that of one of the separators. Consequently, concrete poured into assembled forms cures in a regular lattice, the surface of which is defined by the aligned vertical cavities of stacked forms and the horizontal cavities between rows of forms. Steel reinforcing rods can be inserted into both the horizontal and vertical cavities.

To achieve registry of the vertical cavities, four of the locking members are aligned with each cavity on the upper and lower faces of each parallel side wall so that all eight of the third surfaces of the respective ribs associated with a cavity are coplanar with a vertical plane passing through the center of that cavity.

Figure 6:
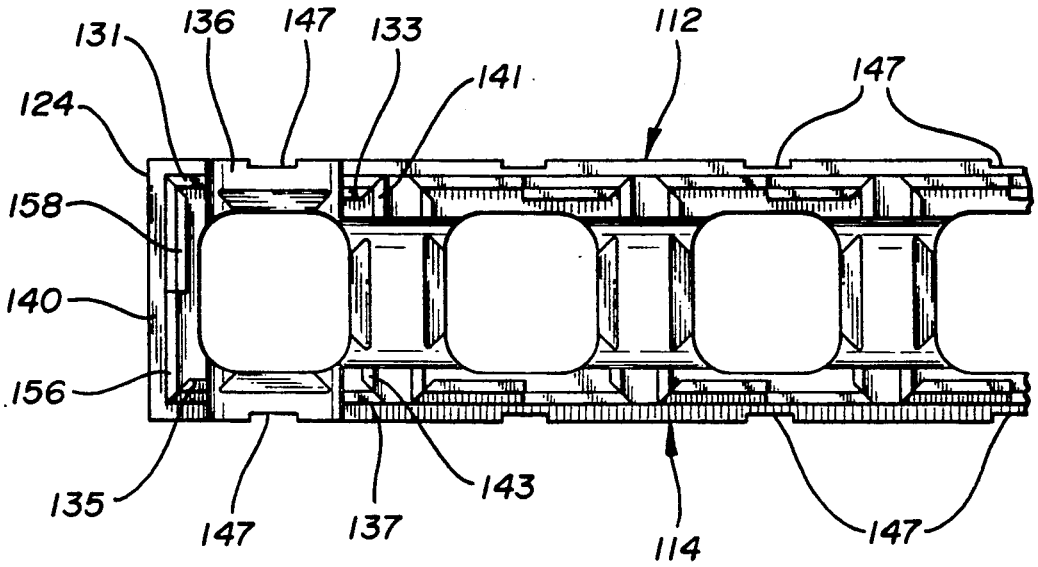
FIG. 6 is a partial top view of an alternative embodiment of the concrete form of the present invention suitable for use as a corner or "T" unit.
Figure 7:
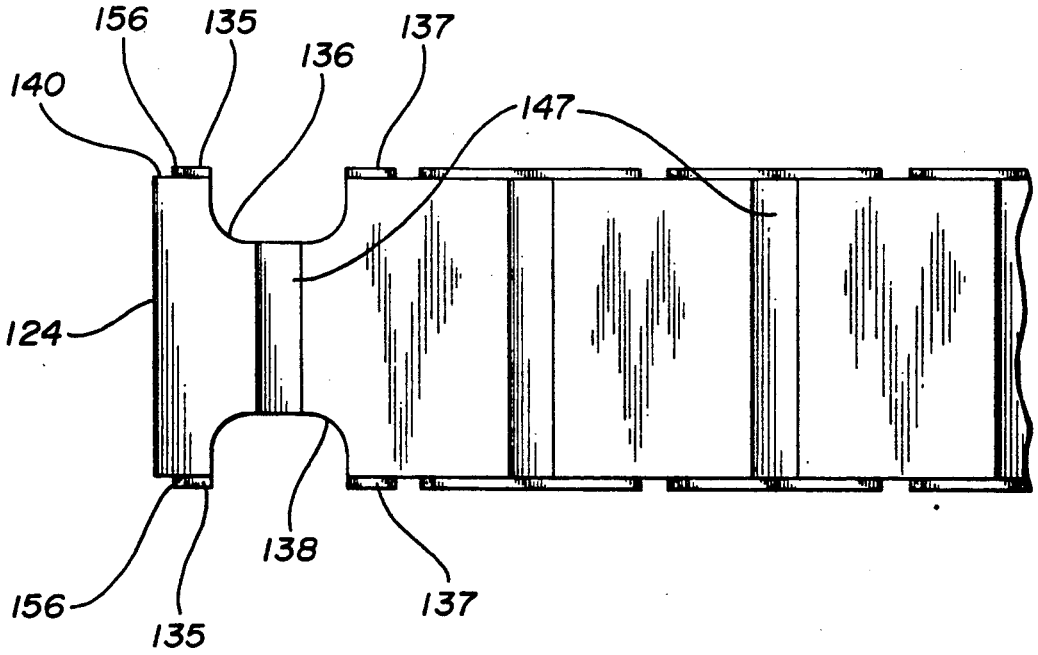
FIG. 7 is a partial side elevation of the concrete form shown in FIG. 6.

In the embodiment shown in FIGS. 6 and 7, the last cavity is rotated 90° so that the concave openings 136 and 138 appear on side walls 112 and 114, thereby permitting one such form to abut another form at a 90° angle, as in a corner or T-joint. Lip 140 is provided on end member 124, as is a locking member composed of first and second ribs 156 and 158 having the construction discussed above. Partial longitudinal ribs 131, 133, 135 and 137 are disposed in analogous relationship on each side of opening 136 (with analogous ribs disposed about opening 138). Partial transverse ribs 141 and 143 are disposed parallel to ribs 156 and 158 and similarly engage the ribs of a corresponding elongated locking member placed on top of or below the depicted form at 90°. Again similar transverse ribs can be associated with each cavity.

With either embodiment, the overall orientation of the composite of forms may result in openings which do not communicate with another form and which thus would permit the escape of concrete. Simple plastic inserts, not shown but corresponding in shape to openings 36, 38, 136, and 138, thus can be provided to be inserted as needed as the composite of the forms is being constructed.

Figure 9:
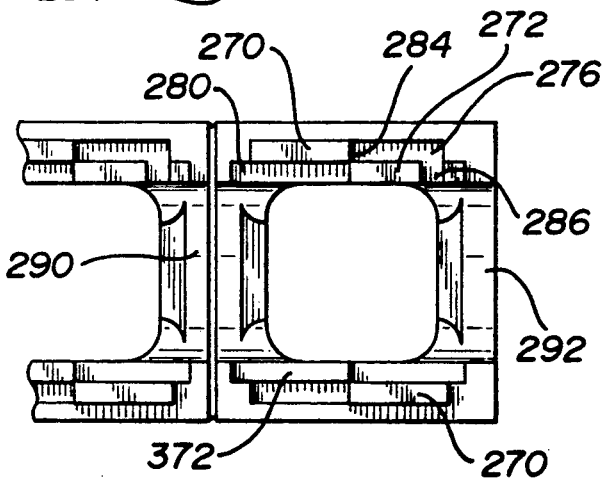
FIG. 9 is a partial top view of another embodiment of the present invention.
Figure 10:
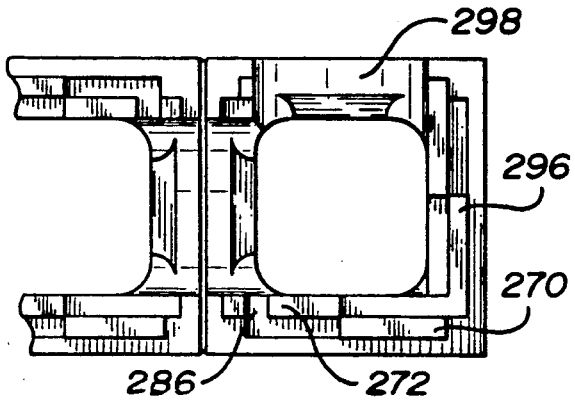
FIG. 10 is a partial top view of another embodiment of the present invention.

Referring to FIGS. 8, 9, and 10, there is shown an alternative embodiment in which a plurality of locking members 250, 252 (in part), 254, 256 (in part), 258 (in part), and 260 (in part) are defined on the upper face 262 and lower face (264) of the form. Locking members 250, 252, and 258 are proximate to side wall 266 and locking members 254, 256, and 260 are proximate to opposite side wall 268. Each locking member proximate to one side wall is in registered, longitudinally spaced relationship to permit engagement of a like locking member of another, coplanarly aligned form. At the same time, the locking member proximate to one side wall is spaced from a corresponding locking member proximate to the other side wall at a distance to permit engagement with a like locking member of another, transversely aligned form.

To accomplish this, each of the locking members consisting of first elongated, generally rectangular rib component 270 (shown with respect to locking member 250) and second elongated, generally rectangular rib component 272. Rib components 270 and 272 are disposed in parallel, offset relationship on, and extend outwardly from, face 262 of the form. Desirably but not necessarily second rib component 272 will have a length corresponding to L+2W in which L is the length of first rib component 270 and W is the maximum width of first rib component 270.

Locking member 250 also includes a first elongated, generally rectangular, channel 274 and second elongated, generally rectangular, channel 276 defined in face 262 of the form on which rib components 270 and 272 are disposed. Channel 274 is coaxial with rib component 272 and adjacent to the other rib component 270 while channel 276 is coaxial with rib component 270 and adjacent to the other rib component 272. One side wall 278 of first channel 274 is defined by a side of the adjacent rib component 270 and end wall 280 is defined by the end of the other, coaxial rib component 272. Similarly, one side wall 282 of second channel 276 is defined by a side of the adjacent rib component 272 and end wall 284 is defined by the end of the other, coaxial rib component 270. First and second channels 274 and 276 are dimensioned to receive a second rib component and a first rib component, respectively (that is, corresponding to 272 and 270), of a like form when engaged in coplanar alignment.

At least one transverse slot 286 is defined in second rib component 272, the slot being dimensioned to receive a second rib component of another form when engaged in transverse alignment. As shown in FIG. 8, transverse slot 286 also is defined in second rib component 272' of opposed locking member 254 proximate to the opposite side wall 268, thereby eliminating the need to reverse a form in the course of placement. As shown in FIG. 9, however, the device can be constructed with only one transverse slot 286 in second rib component 272 with an otherwise analogous second rib component 372 omitting the transverse slot. Such an arrangement requires a single orientation when two forms are engaged in transverse alignment.

Typically each of the channel and the rib component will have a dimension corresponding to about a third of the maximum width of the upper or lower face. The rib components and channels can be provided with a slight, complementary slope to facilitate engagement.

As in the previous embodiment, interior separators 290 and 292 define a plurality of discrete cavities of like configuration between either two interior separators (290) or one interior separator and an end member (292). All of the interior separators such as 290 have a portion removed permitting communication of concrete between two or more cavities.

In the embodiments shown in FIGS. 8 and 9, each end member has a portion removed permitting communication of concrete between two abutting forms. Typically four of locking members are aligned with each cavity on the upper and lower faces of each parallel side wall so that all eight abutting ends of the rib components (two of which are indicated by 280 and 284) associated with a cavity are coplanar with a vertical plane passing through the center of that cavity.

In the embodiment shown in FIG. 10, one cavity defined by an end member has a locking member 296 on the upper face of the end member and one (not shown) on the lower face. In this embodiment, the form has portions removed from the side wall 298 in the region of the end cavity, thereby serving as a corner piece and permitting communication of concrete between the end cavity and a cavity of a second form placed perpendicular thereto.

A number of other variations in the foregoing obviously can be employed. For example, the rotation of one cavity as shown in FIGS. 6 and 7 (so that openings 136 and 138 appear on side walls 112 and 114) is not limited to the last cavity but can occur at intermediate cavities. Such an embodiment is used in forming an intersection of two walls.

Moreover, while FIGS. 6 and 7 show two openings, one on each of the opposing side walls, the openings can be limited to the upper and lower portions of only one side wall, with the opposing side wall portion being solid. Such an embodiment is used in forming a corner intersection of two walls.

Similarly, the invention also extends to a con
crete form combining the features of those shown in FIGS. 1–7 by having solid end walls (such as shown in FIG. 1) and solid side walls; i.e., without concave openings 136 and 138 as shown in FIGS. 6 and 7. Such an embodiment of the form then can be used as a single universal form with the worker cutting such openings on the job as may be required for a given project.

What is claimed is:

1. In a hollow foamed plastic form for concrete having a pair of opposed parallel side walls with planar upper and lower faces, and a pair of opposed end members, the improvement which comprises:

a plurality of locking members defined on the upper and lower faces of said form proximate to a side wall, each locking member (i) being in registered, longitudinally spaced relationship operable to permit engagement of a like locking member of another, coplanarly aligned form, and (ii) spaced from a corresponding locking member proximate to the other side wall at a distance operable to permit engagement with a like locking member of another, transversely aligned form;

each of said locking members consisting of (a) first and second elongated, generally rectangular rib components disposed in parallel, offset relationship on, and extending outwardly from, a face of said form; and (b) first and second elongated, generally rectangular, channels defined in the face of the form on which said rib components are disposed, each of said channels being coaxial with one of said rib components and adjacent to the other of said rib components, one side wall of each of said first and second channels being defined by a side of an adjacent rib component and an end wall of each of said first and second channel being defined by an end of the other, coaxial rib component; said first and second channels being dimensioned to receive a corresponding second rib component and first rib component, respectively, of a like form when engaged in coplanar alignment; and at least one transverse slot defined in said second rib component, said slot being dimensioned to receive a second rib component of another form when engaged in transverse alignment.

2. The foamed plastic concrete form according to claim 1 in which said transverse slot is defined in said second rib component of opposed locking members proximate to both side walls.

3. The foamed plastic concrete form according to claim 1 in which interior separators define a plurality of discrete cavities of like configuration between either two interior separators or one interior separator and an end member and all of said interior separators have a portion removed permitting communication of concrete between two or more cavities.

4. The foamed plastic form according to claim 3 in which each end member has a portion removed permitting communication of concrete between two abutting forms and four of said locking members are aligned with each cavity on the upper and lower faces of each parallel side wall so that all eight abutting ends of said rib components associated with a cavity are coplanar with a vertical plane passing through the center of that cavity.

5. The foamed plastic form according to claim 3 wherein one cavity defined by an end member has a locking member on each of the upper and lower faces of the end member, said form having portions removed from the side walls in the region of said end cavity permitting communication of concrete between said end cavity and a cavity of a second form placed perpendicular thereto.

* * * * *